US011123585B2

(12) United States Patent
Howland

(10) Patent No.: US 11,123,585 B2
(45) Date of Patent: Sep. 21, 2021

(54) ELECTRICAL SAFETY EMERGENCY RESPONSE SYSTEMS AND RELATED METHODS

(71) Applicant: United States of America as represented by the Secretary of the Navy, Arlington, VA (US)

(72) Inventor: Glenn E. Howland, Acton, ME (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 242 days.

(21) Appl. No.: 16/236,433

(22) Filed: Dec. 29, 2018

(65) Prior Publication Data

US 2020/0206548 A1 Jul. 2, 2020

(51) Int. Cl.

| | |
|---|---|
| ***A62B 35/00*** | (2006.01) |
| ***A41D 1/04*** | (2006.01) |
| ***A41D 13/00*** | (2006.01) |
| ***A41D 13/008*** | (2006.01) |

(52) U.S. Cl.

CPC ..... *A62B 35/0018* (2013.01); *A41D 1/04* (2013.01); *A41D 13/0007* (2013.01); *A41D 13/008* (2013.01); *A62B 35/0037* (2013.01); *A62B 35/0043* (2013.01); *A41D 2600/20* (2013.01)

(58) Field of Classification Search

CPC ..... A62B 35/0037; A62B 35/0043; A62B 35/0018; A41D 1/04; A41D 13/0007; A41D 13/008; A41D 2600/20

See application file for complete search history.

(56) References Cited

U.S. PATENT DOCUMENTS 4,551,107 A * 11/1985 Scheurer ..... B63C 9/115 441/112
5,014,359 A * 5/1991 Hanson ..... A41D 13/0012 2/102
5,265,782 A * 11/1993 McNamara ..... A41D 13/12 2/108
5,514,019 A * 5/1996 Smith ..... A41D 13/0007 2/311

(Continued)

OTHER PUBLICATIONS

DBI-SALA, User Instruction Manual Exofit Nex Full Body Harness, ExoFit Nex Full Body Harness, Copyright 2014.

(Continued)

*Primary Examiner* — Alvin C Chin-Shue
*Assistant Examiner* — Shiref M Mekhaeil
(74) *Attorney, Agent, or Firm* — Naval Surface Warfare Center, Crane Division; Christopher A. Monsey

(57) ABSTRACT

An electrical safety system and method is provided which includes a flexible electrical safety vest, a lifeline coupled with the vest in various configurations, and leg straps. The electrical safety vest includes a number of loops which are used to couple the lifeline in a variety of relationships that enable different types of maneuvering of a worker with relation to a hazard. Various embodiments of the invention can be used to rapidly and safety remove a worker from proximity to an immediate threat to their life, health, or safety. Direct and indirect extraction from a danger are enabled. A variety of methods are also provided for operating various embodiments of the invention.

4 Claims, 16 Drawing Sheets

(56) References Cited

U.S. PATENT DOCUMENTS 5,516,234 A * 5/1996 Duchesne ..... B63C 11/08 2/102
5,617,582 A * 4/1997 Burwell ..... A41D 13/0012 2/102
5,803,667 A * 9/1998 Seligman ..... B63C 11/30 405/186
5,829,060 A * 11/1998 Falk ..... A41D 13/0012 2/102
5,970,517 A * 10/1999 Jordan ..... A41D 13/0007 182/3
5,970,520 A * 10/1999 Garofalo ..... B63C 11/04 2/102
6,233,740 B1 * 5/2001 Meyers ..... A41D 13/0007 2/102
RE37,394 E * 10/2001 Woodyard ..... A41D 13/0007 182/3
6,397,392 B1 * 6/2002 Wooley ..... A41D 13/0012 2/102
6,662,373 B2 * 12/2003 Frank ..... A41D 13/0012 2/102
6,889,834 B2 * 5/2005 Ho ..... A45F 3/14 206/373
7,000,255 B1 * 2/2006 Baacke ..... A41D 3/00 2/94
7,458,491 B2 * 12/2008 Cragg ..... F42B 39/02 224/648
7,707,652 B2 * 5/2010 Senegal ..... A63B 21/4043 2/102
8,240,532 B2 * 8/2012 Cragg ..... A45F 3/08 224/648
8,651,235 B2 * 2/2014 Wood ..... A62B 1/14 182/5
8,678,134 B2 * 3/2014 Wood ..... A62B 35/0037 182/5
8,776,266 B1 * 7/2014 Metz ..... A41D 13/0007 2/94
9,079,645 B2 * 7/2015 Barbis ..... B63C 9/11
9,144,294 B2 * 9/2015 Gregory ..... A45F 3/04
9,392,860 B2 * 7/2016 Redli ..... A45F 4/12
9,486,058 B1 * 11/2016 Moreau ..... A41D 1/04
9,616,980 B2 * 4/2017 Barr ..... B63C 9/11
2002/0119715 A1 * 8/2002 Pons ..... B63C 9/26 441/80
2003/0196245 A1 * 10/2003 Schweer ..... A41D 13/0007 2/94
2005/0067221 A1 * 3/2005 Wolner ..... A62B 35/0031 182/3
2007/0066161 A1 * 3/2007 Luis ..... A41D 13/0125 441/106
2007/0135278 A1 * 6/2007 Grigoriev ..... A63B 23/0244 482/124
2007/0219074 A1 * 9/2007 Pride ..... A63B 21/023 482/124
2008/0301863 A1 * 12/2008 Goff ..... A41D 13/0012 2/467
2009/0095232 A1 * 4/2009 McKay ..... A62B 35/0006 119/770
2010/0026025 A1 * 2/2010 McKay ..... A62B 35/0006 294/140
2010/0043112 A1 * 2/2010 Khandelwal ..... F41H 1/02 2/2.5
2011/0030118 A1 * 2/2011 Pratchett ..... A62B 35/0025 2/81
2011/0207586 A1 * 8/2011 Whyatt ..... A63B 21/4017 482/139
2015/0059042 A1 * 3/2015 Aquino ..... A41D 3/00 2/2.5
2015/0296909 A1 * 10/2015 Sachs ..... A41B 1/08 2/84
2016/0242973 A1 * 8/2016 Delaney ..... A61G 1/01
2016/0270460 A1 * 9/2016 Rabinowitz ..... A41D 15/04
2016/0287917 A1 * 10/2016 Remler ..... A01M 31/00
2016/0367021 A1 * 12/2016 Moreau ..... A45F 3/00
2017/0143057 A1 * 5/2017 Morris-Wilton ..... A41D 13/129
2017/0281989 A1 * 10/2017 Wood ..... A62B 35/0043
2017/0307335 A1 * 10/2017 Skifstad ..... A45F 3/06
2018/0056097 A1 * 3/2018 Provencal ..... A41F 9/007
2018/0200548 A1 * 7/2018 Wood ..... A62B 35/0018
2018/0318615 A1 * 11/2018 Van Der Zwaan .... A61G 1/044
2018/0345053 A1 * 12/2018 Bouquier ..... A62B 35/0018
2019/0008222 A1 * 1/2019 Afjeh ..... A41D 27/08
2019/0109349 A1 * 4/2019 Thiel ..... H01L 31/048
2019/0274861 A1 * 9/2019 Gitomer ..... A41D 23/00
2019/0357606 A1 * 11/2019 Venekamp ..... A41D 13/0002
2020/0248989 A1 * 8/2020 Swan ..... F41H 1/02

OTHER PUBLICATIONS

DBI-SALA, Product Specification, ExoFit Nex Arc Flash Harnesses, Copyright 2009.

Naval Ships' Technical Manual Chapter 300 Electric Plant—Generalnaval Ships' Technical Manual Chapter 300 Electric Plant—General, S9086-KC-STM-010, May 1, 2012; http://www.sailorbob.com/files/cqe/NSTM_300.pdf pp. 300-2-18 through 300-2-21, 300-I-1 through 300-I-9.

Navsea Occupational, Safety, Health and Enviroment Control Manual for Navalshipyards; Chapter 230 Oshe Control Manual Rev B, pp. 230-6 through 230-9; 230 A-1 & 230 A-2.

* cited by examiner

ELECTRICAL SAFETY EMERGENCY RESPONSE SYSTEMS AND RELATED METHODS

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200,486) is assigned to the United States Government and is available for licensing for commercial purposes. Licensing and technical inquiries may be directed to the Technology Transfer Office, Naval Surface Warfare Center Crane, email: Cran_CTO@navy.mil.

FIELD, BACKGROUND AND SUMMARY OF THE INVENTION

The present invention relates to systems and methods for providing emergency response or rescue of electrical workers in proximity to electrical systems along an optical angle to separate the worker from an electrical hazard source as quickly as possible in a variety of worker to equipment orientations.

In the course of work and testing of shipboard electrical systems, workers have to work on or in the vicinity of energized equipment. One approach to providing necessary safety is to use a lifeline to extract the worker if they were to receive an electric shock. The U.S. Navy previously used a rope that was draped over the worker and attended to by a safety observer. However, this approach had a variety of deficiencies. For example, attaching a rope to an individual requires a knot being tied and different ways of draping the rope. When a worker has the rope attached to their waist, when yanking them back their upper torso would tend to remain in dangerous proximity to energized equipment or create a risk of physical impact. Also, there are failure modes with defective knot tying to include knots that come untied. Another disadvantage encountered arose from tying the rope to the worker which created movement constraints and discomfort. Another difficulty was creating necessary leverage and enabling the safety worker to apply a sufficient degree of force required to pry an electrocuted person off an electrical source where the worker has involuntary muscle spasms. In many cases, electrocutions can result literally in a "death grip" on a structure when they are electrocuted. Also, there was a need to provide increased arc flash or arc blast protection. Another problem that was encountered arose from being able to perform withdrawal efforts within constrained industrial spaces such as in ships, submarines, or other crowded industrial spaces. Limited range of motion resulted in existing capabilities being unusable. Another related problem arising from attempting to provide a rescue ability from industrial accidents in crowded industrial spaces with a need for safety personnel to act at a distance arises from a need to maneuver a worker away from a hazard event, such as an electrocution event, without creating major additional injuries from slamming them into another structure and creating life threatening injuries from the rescue attempt. Another problem arises from a need for a safety observer to act from a distance that is outside of an electrocution, arc flash, arc blast, or other types of hazards such as explosive blasts associated with a given event. A direct extraction path may not exist therefore use of a rope is not viable nor is a safety observer in a position to easily maneuver an injured person. Another problem encountered was management of slack in a rescue rope given attachment mechanisms to workers tended to create a response time lag due to slackness in an attachment arrangement with a worker. Enabling a worker to effectively operate while reducing slack to a necessary extent posed a major problem in creating a given exemplary rescue system for use in meeting industrial safety needs in this context. Several different aspects of this disclosure provide means to more effectively manage slack to reduce force input to movement response times. Protection from heat and electrical conduction as well as physical impacts also are needed but in a way that does not significantly impede a worker's ability to function or operate to perform various industrial tasks. Another set of considerations or constraints also arises from use of various embodiments of this disclosure or their equivalents which are suitable for work with particular classes of high hazard materials or equipment such as high voltage systems. Accordingly, a need exists to be able to rapidly apply a very large amount of force in a confined or crowded industrial space, using limited ranges of motion, to withdraw a worker from an industrial accident event, such as an electrocution event, more uniformly, quickly, and safely with relatively low costs.

Generally, an exemplary safety system and set of related methods are provided including an enclosing structure such as a flexible vest with various structures including a safety line with loops, grab or dragging handgrips in various orientations on the vest, padding which provides impact protection when a member is yanked forcefully away from an electrical discharge, and material which is resistant to electrical arc flashes or events. Various methods are also provided which are optimized to enable rapid and safer extraction of a worker from proximity to an electrical discharge event. A lifeline and various attaching relationships and structures with the enclosing structure is provided. Additional embodiments can include various elements which enable altering a withdrawal or extraction path from a direct to an indirect path. Exemplary approaches to creating an indirect path can include use of various connection points and angles between a lifeline and a vest (e.g., a side at a mid-torso point) that enable a rotational movement to navigate a hazard and obstructions or via a means such as a pulley attached via non-permanent attaching structures such as a high power or attaching force magnet, a suction system, adhesive system, etc. Such non-permanent attachment mechanism is needed given a constraint that prevents modification of industrial equipment.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1A:
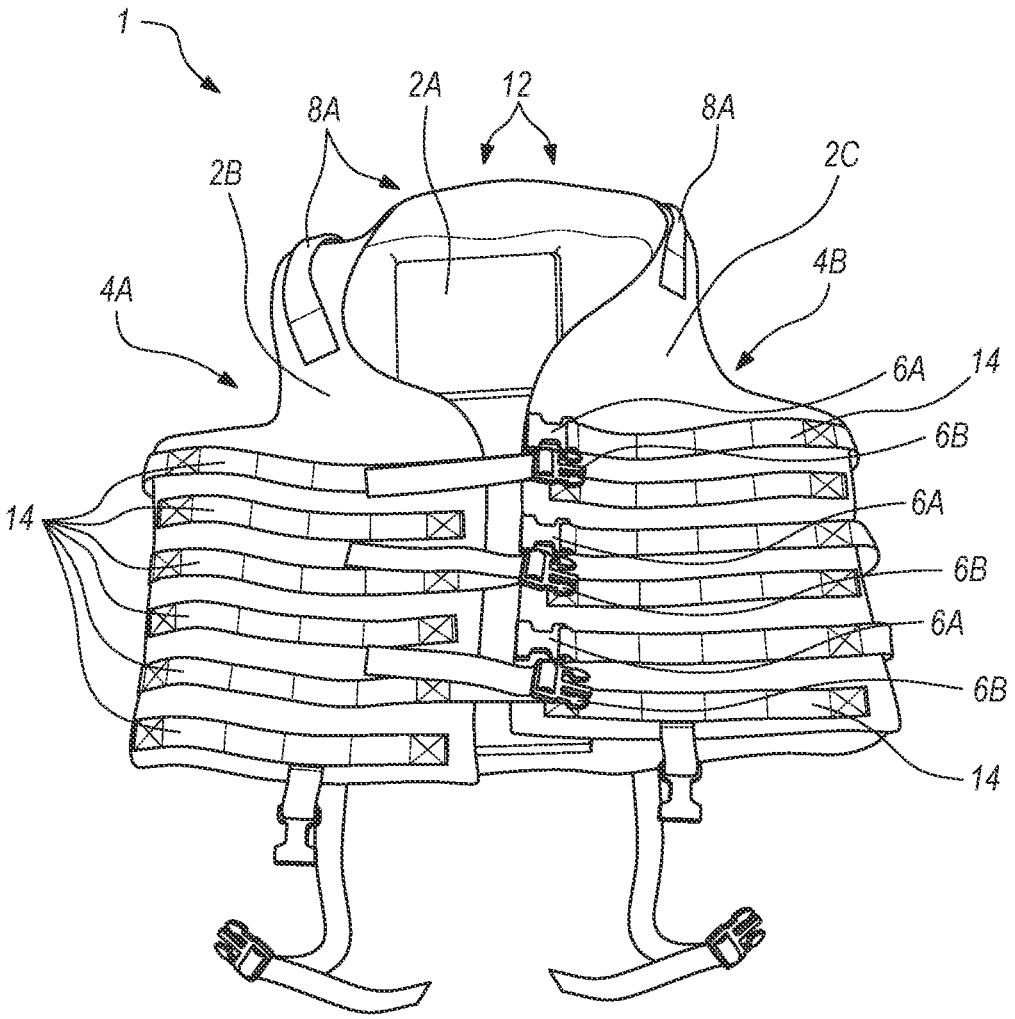
FIG. 1A shows a front view of an electrical safety vest system or flexible vest or enclosing structure in accordance with one embodiment of the invention.

FIG. 1A shows a front view of an electrical safety vest system in accordance with one embodiment of the invention. In particular, a flexible vest or enclosing structure 1 is provided that is formed with first 2A, second 2B and third 2C enclosing panels or sections. The exemplary flexible vest or enclosing structure 1 is formed with a first 4A and second 4B arm aperture sections respectively formed between a portion of the first 2A and second 2B enclosing panels or sections as well as a portion of the first 2A and third 2C enclosing panels or sections. A number of first 6A and second 6B adjustable straps and buckles are provided respectively attached to and for coupling opposing and facing sections of the second 2B and third 2C enclosing panels or sections. A number of flexible handle grip sections 8A (one is not shown attached to a back section of the first enclosing panel or section 2A near a collar section 12) are attached respectively to the first 2A, second 2B, and third 2C enclosing panels or sections in proximity to the first and second arm aperture sections 4A, 4B and a collar section 12 of the flexible vest or enclosing structure 1. A number of rows of spaced apart first loops 14 (e.g., a Modular Lightweight Load-Carrying Equipment or M.O.L.L.E. System and/or Pouch Attachment Ladder System or PALS webbing) is disposed on or coupled with an outer side of the first 2A, second 2B, and third 2C enclosing panels or sections (note, first loops 14 are also coupled with a back side of first enclosing panel or section 2A but are not shown in FIG. 1A as this is a front view). A rescue line 41 is provided (not shown in FIG. 1A but see FIG. 4, 41) and formed with a number of spaced apart second loops (See FIG. 4, 41A) disposed along the line 41, wherein the line 41 is coupled with at least one of the first loops 14 (see below for more details on coupling of line 41 with at least first loops 14). In at least one embodiment, the line 41 is formed from a Kevlar® material at is at least eight feet in length.

Figure 1B:
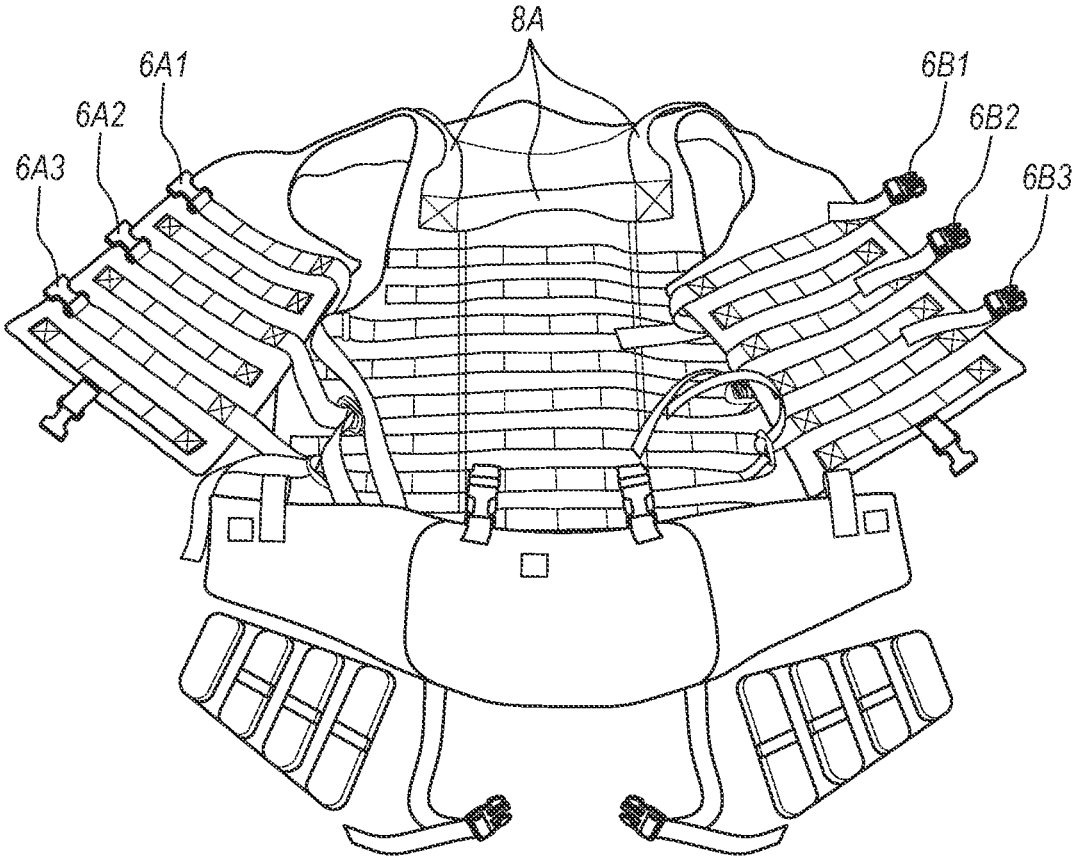
FIG. 1B shows a rear view of the exemplary FIG. 1A flexible vest or enclosing structure.

FIG. 1B shows a rear view of the exemplary FIG. 1A flexible vest or enclosing structure 1. In this example, there are three complete sets of full body loops 18, 19, and 20 incorporated in the MOLLE/PALS design that terminate or end with female 6A1, 6A2, 6A3 and male 6B1, 6B2, and 6B3 connectors for closure. An operator will or should weave a worker's end of an exemplary lifeline or line 41 through the webbing to ensure encapsulation or coupling with at least two of these three full body loops. The drag handles 8A can also be provided for to use as an additional means of emergency movement or dragging in of a worker who has suffered an accident or been exposed to a hazard.

Figure 2:
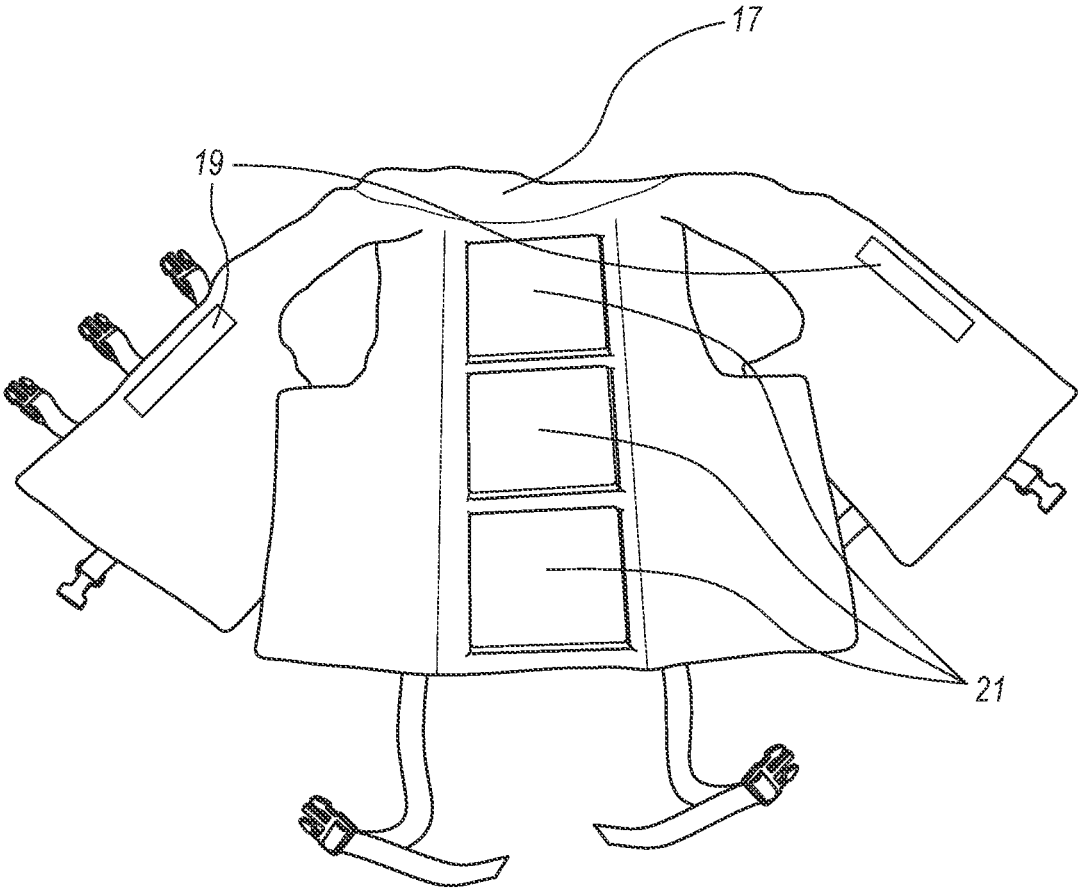
FIG. 2 shows a laid open view of an interior of the FIG. 1A or FIG. 1B electrical safety vest/flexible vest or enclosing structure/system in accordance with one embodiment of the invention

FIG. 2 shows a laid open view of an interior of the FIG. 1A flexible vest or enclosing structure (e.g., electrical safety vest) 1 in accordance with one embodiment of the invention. This view shows foam or cushion pads 21 sewn into a center section of the first enclosing panel or section 2A. The foam or cushion pads 21 provide impact protection for a wearer's spine or back. Foam 17 is also formed into collar sections 12 of the exemplary flexible vest or enclosing structure 1 to provide additional impact protection. Pockets 19 are also provided in interior portions of the second enclosing panel or section 2B and third enclosing panel or section 2C to provide a protective storage structure or capability that further shields potentially conductive objects from potential interaction with an external electrical hazard and prevents such objects from falling out and creating foreign object damage risks.

Figure 3:
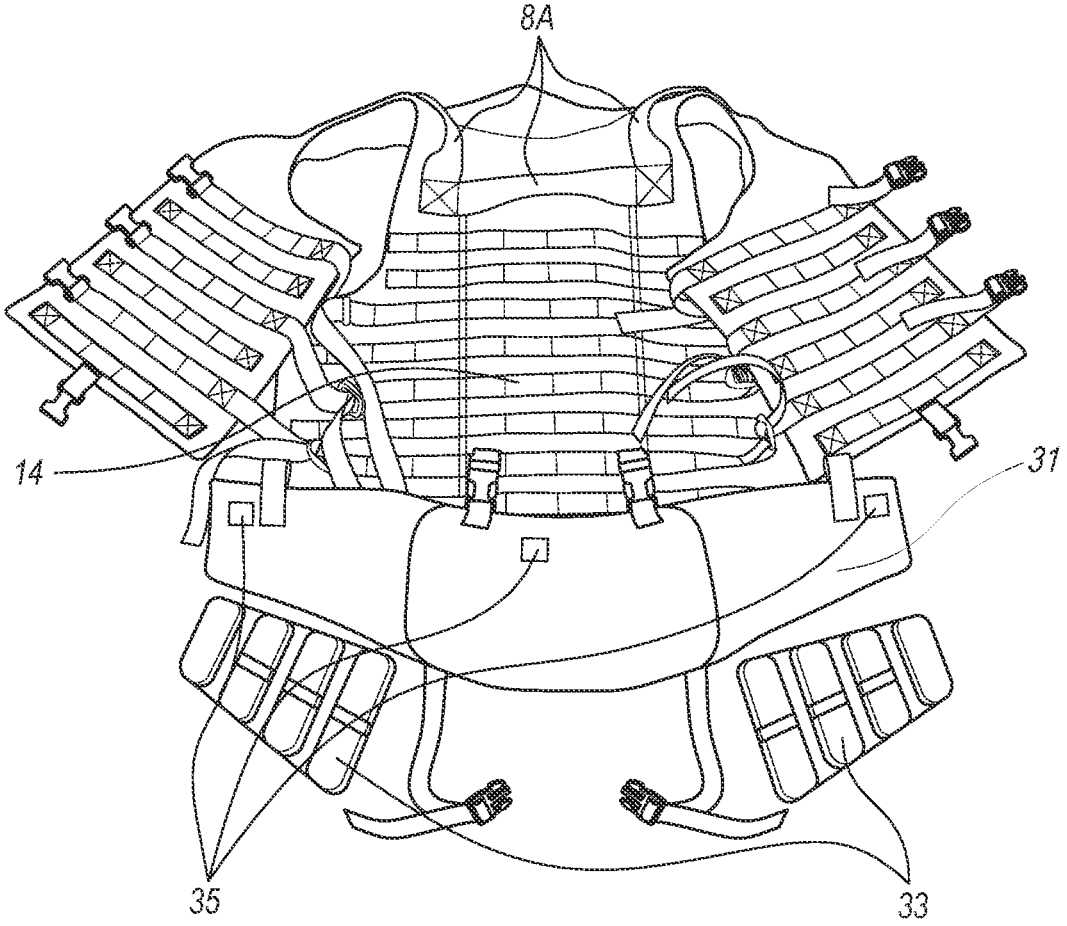
FIG. 3 shows a rear view of the FIGS. 1A-B and FIG. 2 electrical safety vest system or flexible vest or enclosing structure in accordance with one embodiment of the invention.

FIG. 3 shows a rear view of the FIGS. 1A-1B and FIG. 2 electrical safety vest system in accordance with one embodiment of the invention. A number of first protection extension panels 31 are provided that are detachably coupled with a side of the flexible vest or enclosing structure 1 opposing a collar section 12 of the vest or enclosing structure 1. Drag handles 8A (e.g., three in this embodiment) are provided for safety staff conduct victim extraction. Each of the exemplary first protection extension panels 31 are formed with a sheet or flat section (or pockets) and one or more coupling sections (straps and buckles for example) that selectively couples the first protection extension panels 31 with the flexible vest or enclosing structure 1 (e.g., 2A, 2B, and 2C). A number of second protection extension panels (not shown but coupling sections 35 with the first protection extension panels 31 are shown) are provided and detachably coupled with the first protection extension panels 31 that each are formed to extend past at least one edge of a respective one of the first protection extension panels 31, wherein each the second protection extension panels (not shown) are formed with a sheet section and one or more coupling sections 35 (e.g., Velcro®) that selectively couples the second protection extension panels (not shown) with the first protection extension panel panels 31. A number of foam or cushion sections 33 are provided and coupled or inserted within with one or more sections of the first protection extension panels 31 as well as the number of protection extension panels (not shown). Foam or cushion sections 33, such as EVA foam, which slides into pocket sections in the vest or attached to the vest which are formed to be flexible or articulable for ease of movement by user and impact protection. Extension protection pad(s) for taller users. Uses buckles for attachment and quick removal when not needed. EVA (ethylene-vinyl acetate) foam which slides into pocket or enclosure sections in the vest or attached to the vest which are formed to be flexible or articulable for ease of movement by user and impact protection. Hip or back extension wings (not shown) for larger users (can be removed and attached with installed Velcro®.

Figure 4:
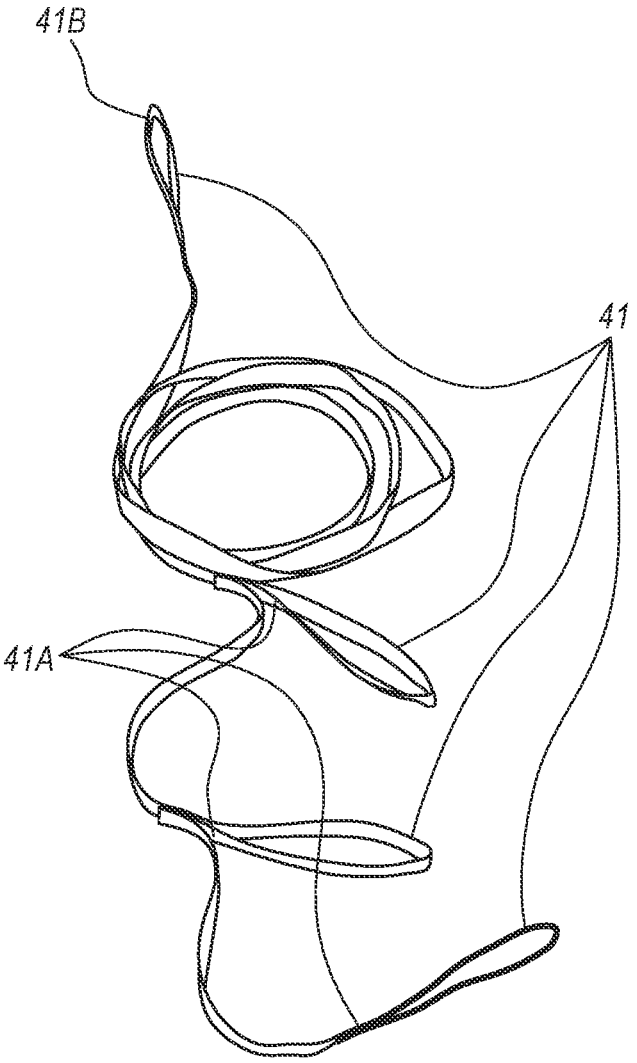
FIG. 4 shows a lifeline or line used with an embodiment of the invention.

FIG. 4 shows an exemplary lifeline or line 41 used with an embodiment of the invention such as FIGS. 1A-B and FIGS. 2-3. Loops 41A, 41B are provided in the line 41 for use by workers (e.g., safety observer and electrical worker). Exemplary lifeline. Can be formed from Kevlar® based flat-web design with one loop 41B on a user or worker with the flexible fext or enclosing structure 1 end for use in attaching the line 41 to the vest 1 and three wrist loops 41A for a Safety Observer (allows for variance in position of work boundary) on an opposing end of the lifeline or line 41. In one embodiment, a line or lifeline 1 can be formed with an overall length of, e.g., 8 feet.

Figure 5:
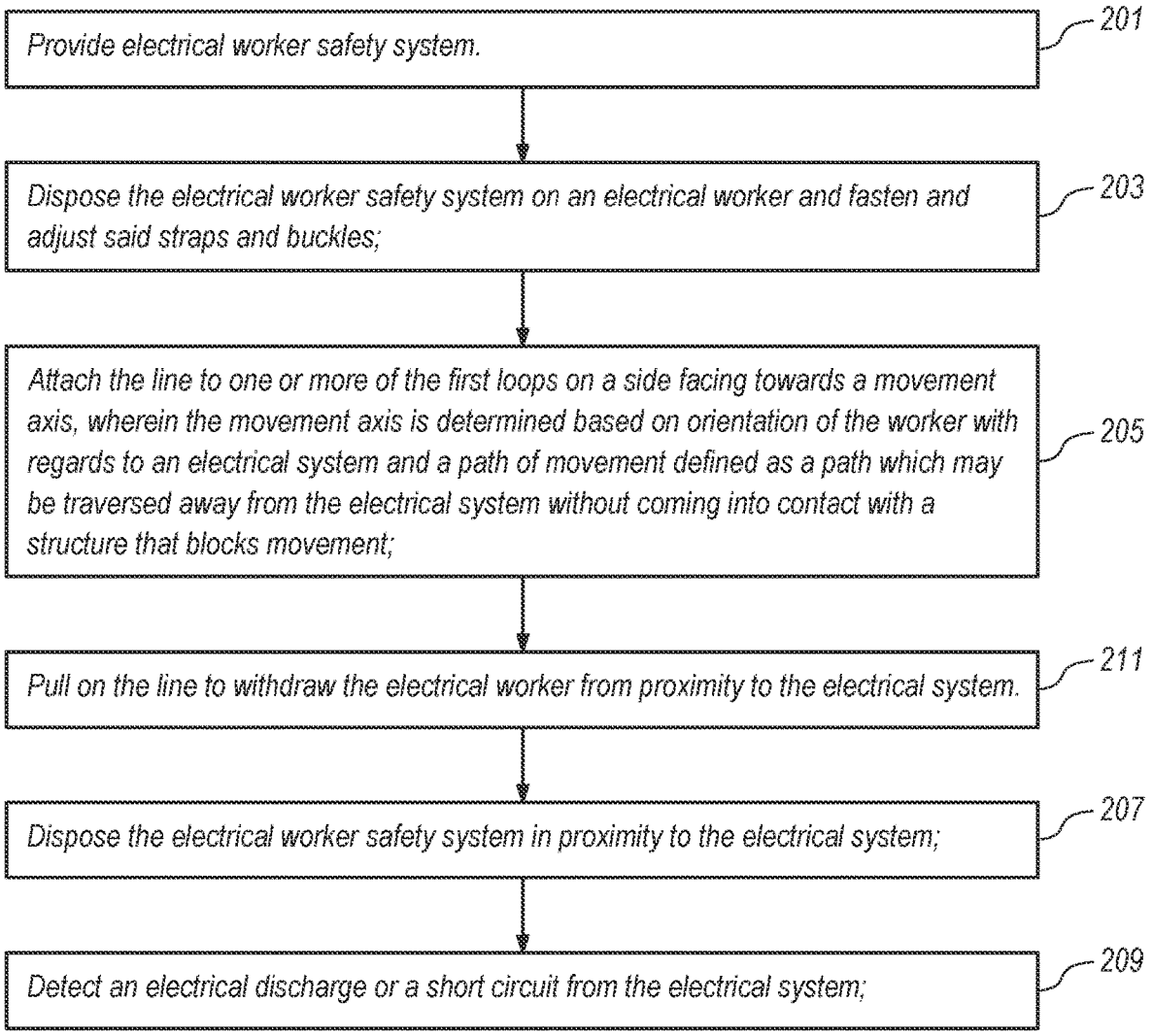
FIG. 5 shows a method of use associated with at least the FIGS. 1A-B and FIGS. 2-4 embodiment(s) of the invention.

FIG. 5 shows an exemplary method of use associated with at least the FIGS. 1A-B and FIGS. 2-4 embodiment of the invention. In particular, at Step 201, an electrical worker safety system is provided such as discussed above and shown in FIGS. 1A-B and FIGS. 2-3. (e.g., a flexible vest or enclosing structure formed with first 2A, second 2B, and third 2C enclosing panels or sections, wherein the flexible vest or inclosing structure 1 is formed with a first and second arm aperture sections 4A, 4B respectively formed between the first 2A and second 2B as well as first 2A and third 2C enclosing panels; a number of first and second adjustable straps and buckles 6A, 6B respectively attached to and for coupling opposing and facing sections of the second and third enclosing panels or sections 2B, 2C; a number of flexible handle grip sections 8A attached respectively to the first 2A, second, 2B, and third 2C enclosing panels or sections in proximity to the first and second arm aperture sections 4A. 4B and a collar section 12 of the flexible vest or enclosing structure 1; a number of spaced apart first loops 14 disposed on or coupled with an outer face or side of the first 2A, second 2B, and third 2C enclosing panels or sections; a line or lifeline 41 formed with a number of spaced apart second loops 41A, 41B disposed along the line or lifeline 41, wherein the line or lifeline 41 is coupled with at least one of the first loops 41A, wherein the line comprises a Kevlar® material at is at least eight feet in length in one embodiment; a number of first protection extension panels 31 detachably coupled with a side of the flexible vest or enclosing structure 1 opposing the collar section 12 of the vest or enclosing structure 1, each said first protection extension panels 31 formed with a sheet section and one or more coupling sections 35 that selectively couples the first protection extension panels 31 with the flexible vest or enclosing structure 1; a number of second protection extension panels (not shown in the drawings) are optionally and detachably coupled with the first protection extension panels 31 that each are formed to extend past at least one edge (or another portion) of a respective one of the first protection extension panels 31, wherein each said second protection extension panels formed with a sheet or planar section and one or more coupling sections 35 that selectively couples the second protection extension panels (not shown) with the first protection extension panels 31 via coupling structures (e.g., Velcro®); and a number of foam or cushion sections coupled with one or more sections of the first 2A, second 2B, and third 2C enclosing panels sections. The plurality of protection extension panels (first extension panels 31 and second extension panels (not shown but connected via coupling sections 35) can also include additional impact protection foam or cushion sections inserted into the protection extension panels.

At Step 203: Dispose or couple the exemplary electrical worker safety system including, e.g., flexible vest 1 provided in Step 201 on an electrical worker and fasten and adjust the straps and buckles 6A, 6B, etc. At Step 205: Attach the line 41 to one or more of the first loops on a side facing towards a movement axis, wherein the movement axis is determined based on orientation of the worker with regards to an electrical system and a path of movement defined as a path which may be traversed away from the hazardous location or electrical system without coming into contact with a structure that blocks movement. At Step 207: Dispose the electrical worker safety system in proximity to the hazardous location or electrical system. At Step 209: Detect an electrical discharge or a short circuit from the electrical system. At Step 211: pull on the line to withdraw the electrical worker from proximity to the electrical system.

Figure 6:
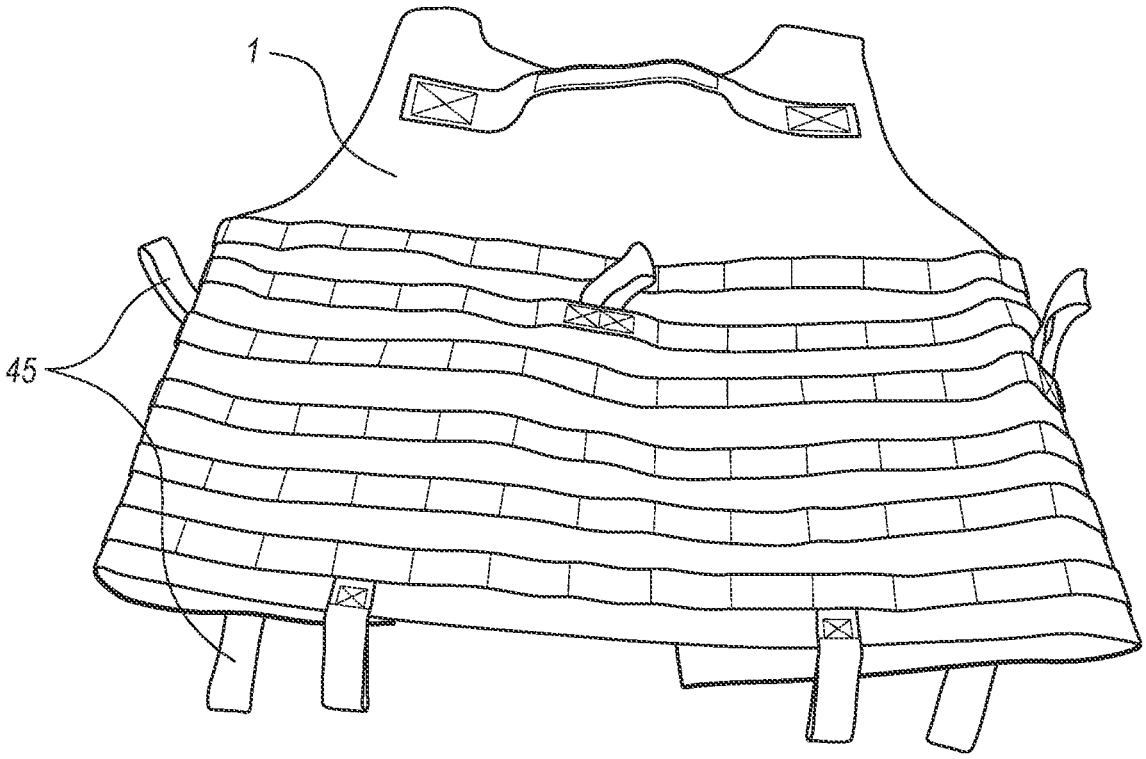
FIG. 6 shows an alternative embodiment of an electrical safety vest to include additional lifeline engaging loops or structures which enable connections between the vest and the lifeline or line to enable application of specific vectors of withdrawing force and movement of a worker.

FIG. 6 shows an alternative embodiment of an electrical safety flexible vest or enclosing structure 1 to include additional lifeline engaging loops or structures 45 which enable connections between the flexible vest or enclosing structure land the lifeline (See FIG. 4) to enable application of specific withdrawal paths or vectors of withdrawing force and movement of a worker (e.g., rotational or spin force). In the course of developing the flexible vest or enclosing structure 1 and lifeline 41, a goal was to remove as many points of failure as possible. An exemplary 'lifeline' 41 can be a rope with a loop tied at an electrical worker's end in some way. An exemplary coupling could be enabled by adding a loop end to the lifeline and the weaving the lifeline 41 through various loops 14 of the vest (e.g., MOLLE/PAL web loops) then having the lifeline 41 pass through one of the additional lifeline engaging loops or structures 45 then pass the lifeline 41 back to the safety observer so pull leverage can be applied at the additional lifeline engaging loops or structures 45. A lifeline 41 can be engage with a lateral position or side 45A of the vest 1 which enables a rotational or spin movement to spin a worker away from a hazard and thereby enable an adjusted or indirect movement away from a hazard in a confined space such as an access panel door so as to avoid impact with the door (e.g., See FIG. 9 lateral or side attachment point 61B enabling rotational or twisting movement). Various strength of the line or rope 41 can be provided for. For example, a Kevlar® infused web strap was chosen for one embodiment with a nine hundred pound breaking strength.

Figure 7:
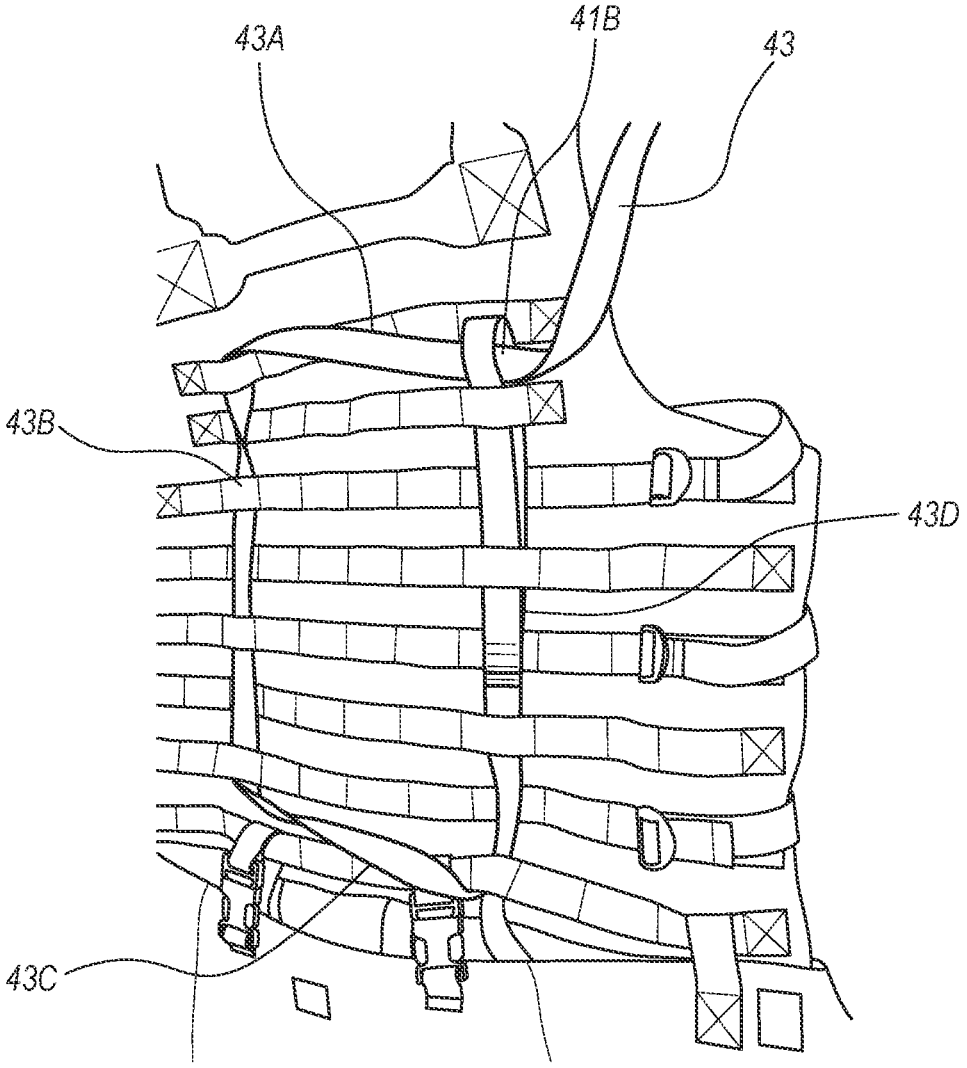
FIG. 7 shows a view of an exemplary electrical safety vest with an interweaving of the lifeline so as to reduce response time and impact of withdrawal of slack to a safety line from a pulling motion on the lifeline.

FIG. 7 shows a view of an exemplary electrical safety vest with an interweaving of the lifeline in cinch weave path pattern that includes weave path segments 43A, 43B, 43C, and 43D in a square loop. Such a cinch weave can reduce response time and impact of withdrawal of slack to a safety line from a pulling motion on the lifeline. Also, a knot can be a point of failure. With that in mind, design efforts were directed to remove or modify items that could fail such as a knot. Design teams looked at using a single composite D-ring on the end of the lifeline 41 and a permanent attachment point 45 on the flexible vest or enclosing structure 1. Because no two electrical or other hazardous location jobs are the same, a decision was made to provide maximum flexibility in attaching a given exemplary lifeline 41. To this end, MOLLE/PALS designs including numerous loops 14 were used. The exemplary lifeline or line 41 was tested using a 'cinching method' or cinch weave approach (e.g., see FIG. 7). In this approach, an exemplary lifeline or line 41 is woven through an exemplary MOLLE/PALS webbing 14 and run back through the worker's end loop 41B. An end loop 41B was sewn into the exemplary lifeline 41 on the electrical worker's end to eliminate a need for a knot. A quad stitch was chosen for connecting various elements for strength. A given design can incorporate as many stitches in the MOLLE/PALS webbing as viable or possible to decrease stich failure from abrupt application of force (not a design issue for normal MOLLE/PAL systems). When the FIG. 7 configuration or approach is used to implement an exemplary chinch weave pattern, workers can be directed to weave the lifeline or line 41 through at least two of the three MOLLE/PALS webbing loops 14 (e.g., see FIG. 2) that are in line or made up of a continuous piece of material that forms loops 14 that are also in close proximity to front side buckles 6A, 6B. This exemplary configuration also allows a supervisor or safety observer to plan for implementing how a worker, e.g., an electrical worker, is extracted. In the picture above (FIG. 2), the electrical worker will have his shoulders and head extracted first, and depending on where the Safety Observer is standing, a possible twisting or rotational capability can be added by how the lifeline or line 41 is connected to the flexible vest or enclosing structure 1. This exemplary MOLLE/PALS webbing embodiment extends around a worker's entire torso and allows for as many as thirty-six hundred connection of the lifeline. An exemplary supervisor can determine and enable an extraction path that the electrical worker's body will take during an extraction using an exemplary flexible vest or enclosing structure (electrical safety vest and system) 1, connection point, and alignment of the lifeline or line 41 along the extraction path.

In at least some embodiments, a Safety Observer's lifeline or lines end has three wrist loops installed (e.g., See FIG. 4, 41A). This wrist loop 41A arrangement allows for maximum flexibility in where the observer stands. A given wrist loop 41A gives the Safety Observer positive control of the electrical worker without an added risk of a missed grip on the lifeline or line 41. In the past, the Safety Observer would do their best to grip the rope. There's little chance of the lifeline or line 41 slipping from the Safety Observer's grasp with this improved arrangement including wrist loops at a specified set of distances along the lifeline or line 41.

Figure 8:
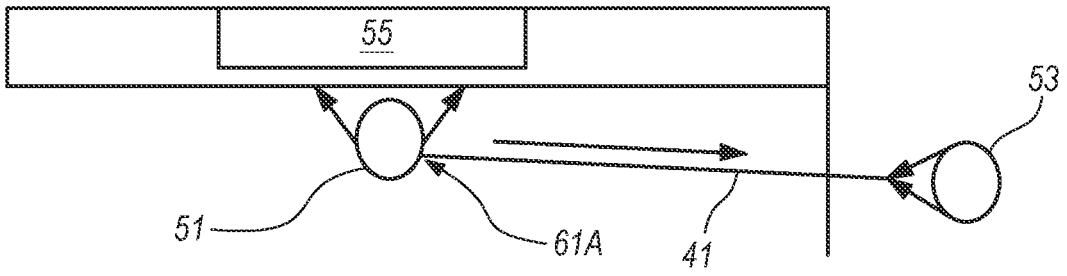
FIG. 8 shows one exemplary lifeline attachment relationship with an exemplary vest to enable a withdrawal path along a straight line without obstruction thereby allowing a direct pull.

FIG. 8 shows one exemplary lifeline 41 attachment relationship or angle 61A with an exemplary flexible vest or enclosing structure 1 worn by an electrical worker 51 to enable a withdrawal path along a straight line without obstruction thereby allowing a direct pull away from an electrical source 55 by the safety observer 53.

Figure 9:
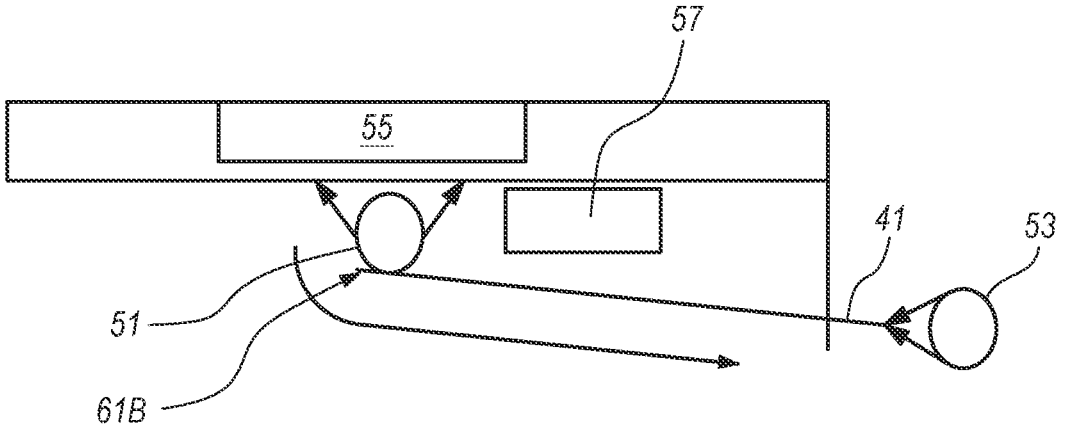
FIG. 9 shows a side or lateral lifeline attachment with an exemplary electrical safety vest to enable a rotational or twisting withdrawal to enable maneuvering of an a worker around an obstruction or hazard.

FIG. 9 shows a side or lateral lifeline or line 41 attachment relationship or angle 61B with a side (e.g., via additional lifeline engaging loops or structures 45) of an exemplary flexible vest or enclosing structure 1 worn by an electrical worker 51. This embodiment enables a rotational or twisting withdrawal motion to enable maneuvering of a worker 51 around an obstruction or hazard 57 when the safety observer 53 yanks on the lifeline or line 41.

Figure 10:
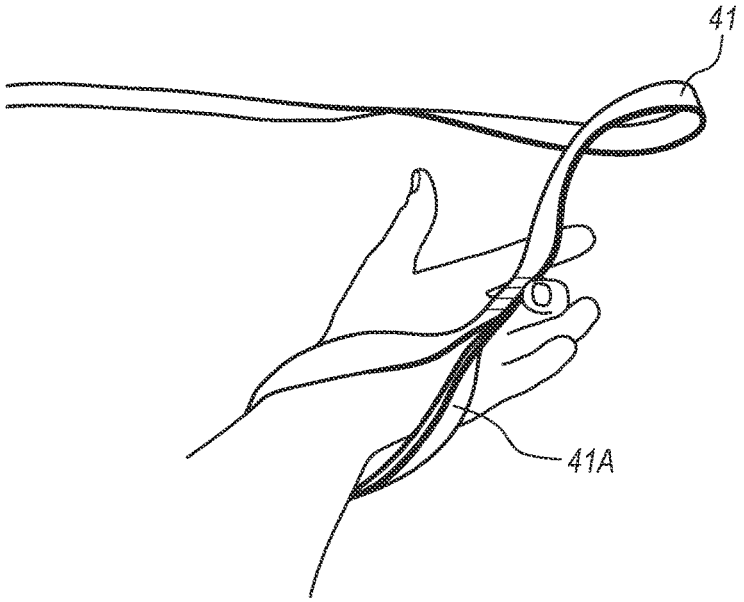
FIG. 10 shows a close up view of one end of an exemplary lifeline with wrist straps for a safety observer with an observer's hand through one of the wrist straps.

FIG. 10 shows a close up view of one end of an exemplary lifeline with wrist straps 41A for a safety observer. An observer's hand is shown passed through one of the wrist straps 41A. These wrist straps allow for adjustment of slack in the lifeline 41 due to differing relative positions of an electrical worker wearing an exemplary safety system, e.g., vest 1, and position of the safety observer with their hands arms positioned for application of maximum immediate leverage. In other words, selection of a given safety observer wrist loop 41 is done in part to account for this relative position between worker and safety observer in view of a given length of the lifeline 41 and where a safety observer must stand or be located in order to stay outside of a Safe Work Boundary (e.g., FIG. 15, 81).

Figure 11:
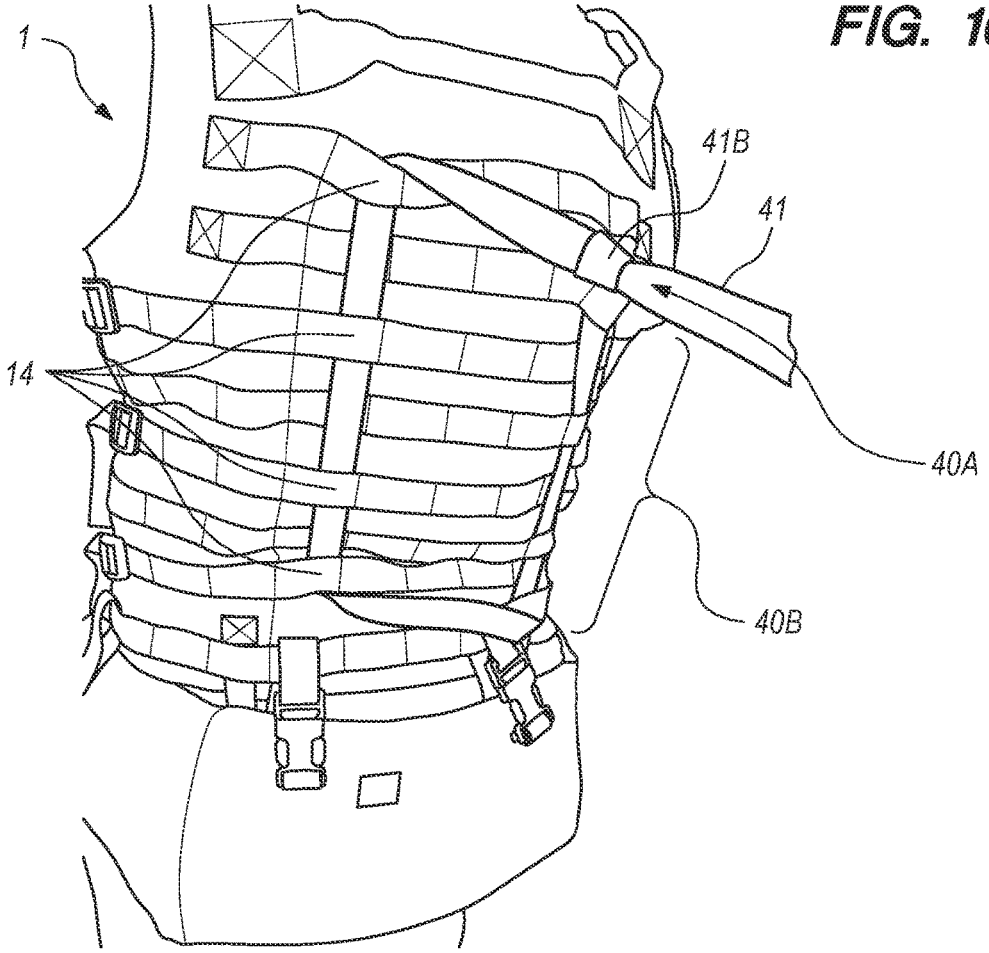
FIG. 11 shows an exemplary electrical safety vest worn by a worker with an exemplary lifeline interwoven through loops of the exemplary safety vest in a cinch weave pattern and path that includes a series of weave path segments which reduces response or lag time between application of force by a safety observer and withdrawal of slack within the vest loops.

FIG. 11 shows an exemplary electrical safety vest worn by a worker with an exemplary lifeline interwoven through loops 14 of the exemplary safety vest in the FIG. 7 cinch weave path pattern that includes a series of weave path segments which reduces response or lag time between application of force by a safety observer and withdrawal of slack within the vest loops 14. When a Safety Observer pulls the lifeline or line 41, the lifeline or line 41 cinches up or is pre-tensioned (see FIGS. 11, 12, and 13). Therefore, the flexible vest or enclosing structure 1 should be donned with little to no slack in lifeline sections 41 that are woven or passed into the loops 14. Also, the Safety Observer must be prepared by having their arm extended in front to ensure adequate power in their arm stroke when the lifeline cinches up.

In at least some embodiments, an exemplary lifeline or line 41 can be attached to provide an optimal or best angle/movement of the electrical worker when pulled. An optimal or best angle/movement can e determined based on an expected attitude or orientation of the worker while at work in a hazardous location. If the worker is working in an energized panel in a standing position, one optimal approach would be to have the cinch loop near the upper back (e.g., see FIG. 3). This arrangement can cause a worker's upper body to move first when the lifeline or line 41 is pulled, ensuring the worker's head stays clear of internal or particular hazards in close proximity. If an exemplary lifeline or line 41 is attached around the worker's waist, the upper body will tend to dip into the panel when the Lifeline 41 is pulled, risking a secondary shock/mechanical injury. Moreover, a given lifeline 41 attachment should take advantage of as many stitches as possible to distribute the load across the whole torso.

Figure 14:
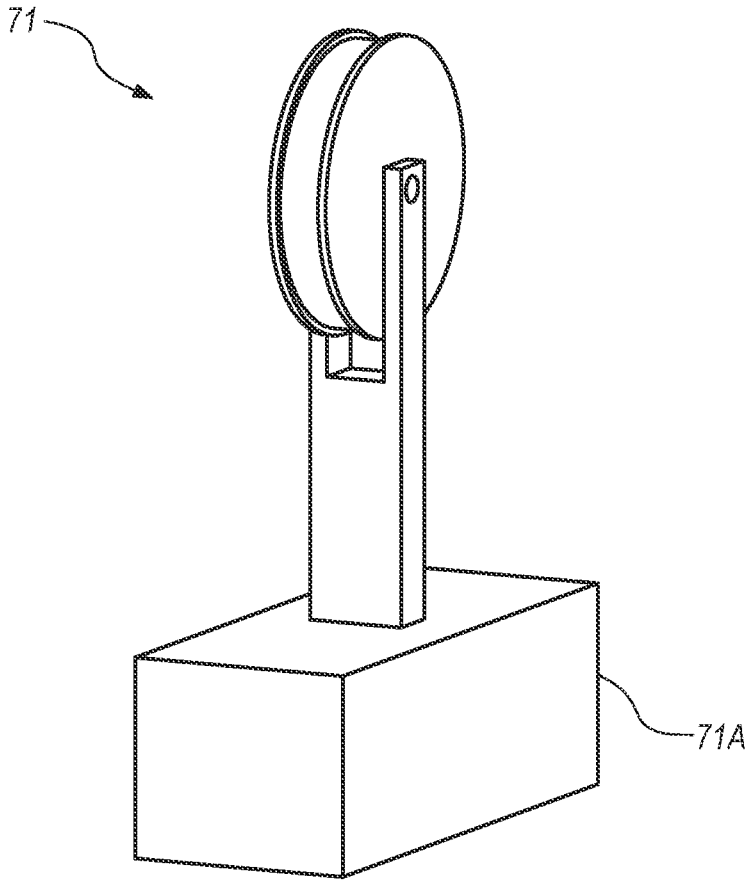
FIG. 14 shows an exemplary pulley and temporary exemplary attaching structure that can be used to alter a withdrawal or extraction path from a direct path to an indirect path to avoid obstacles or hazards that otherwise would be encountered via a direct withdrawal path.

In at least some embodiments, an exemplary lifeline or line 41 should encapsulate at least two of the "fully body" loops (e.g., see FIG. 1A, 14; FIG. 1B, 18, 19, 20). These full body loops 14 include the webbing associated with six adjusters and the three buckles (FIG. 1B, 6A1-6A3, 6B1-6B3). By utilizing the weaving pattern and skipping to the MOLLE/PALS next row along a weave path, the exemplary lifeline or line 41 is passed through an underside of or through a given loop 14 along a weave path and then an upper side or over a top of a given skipped adjacent loop 14. This alternating lifeline or line 41 coupling with a given loop 14 ensures an exemplary lifeline or line 41 can be securely coupled with loops 14 of a flexible vest or enclosing structure 1 to enable a sufficiently strong pulling force can be used to pull the electrical worker off of a hazard site even in the event of multiple failures to stitching or connecting of a given loop 14 with corresponding sections of the flexible vest or enclosing structure 1. A given flexible vest or enclosing structure 1 should be adjusted to a snug fit by utilizing the nine adjusters (e.g., straps and buckles, 6A, 6B). In at least some embodiments, leg straps (not shown) are also provided that are connected to a lower section of the flexible vest or enclosing structure 1 should also be worn to further secure a worker in place with the vest or enclosing structure 1. Exemplary embodiments of leg straps can include straps which connect a worker's legs with the flexible vest or enclosing structure. Exemplary leg straps can couple with a worker's feet or another portion of their legs or lower torso such as by wrapping straps or a harness around a worker's buttocks or upper thighs. Examples of leg straps can include thigh straps or a climber's harness which is coupled to one or more sections of an exemplary flexible vest or enclosing structure 1. Use of the leg straps is important. In at least some embodiments, exemplary leg straps minimize vertical slack in the flexible vest therefore allow an exemplary Lifeline to cinch up quicker. By donning an exemplary flexible vest or enclosing structure 1 with it as snug as is comfortable (along with applicable leg straps), a cinch up or response between application of withdrawal force on a given flexible vest or enclosing structure 1 is minimized. A flexible vest or enclosing structure 1 (e.g., an electrical safety vest (ESV)/lifeline interface section 40A can be formed by interface area of MOLLE/PALS loops 14 and lifeline loop 41B (and optionally additional lifeline engaging loops or structures 45).

Figure 12:
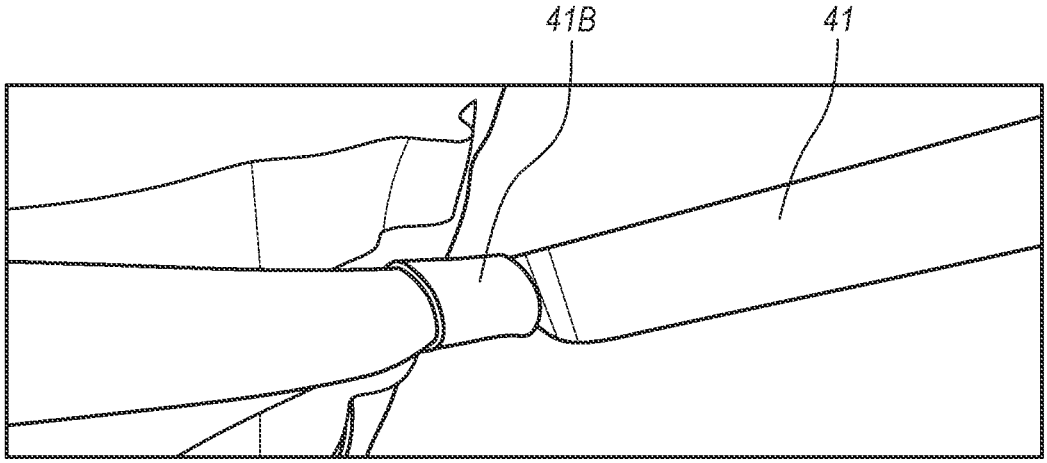
FIG. 12 shows a close up view of the exemplary lifeline and vest shown in FIG. 11 with an end of the lifeline formed as a loop with another portion of the lifeline passed through it as a part of the exemplary cinch weave pattern.

FIG. 12 shows a close up view of an exemplary lifeline 41 and vest 1 shown in FIG. 11 with a worker end of the lifeline 41 formed as a loop 41B with another portion of the lifeline 41 passed through the lifeline worker end loop 41B as a part of the exemplary cinch weave pattern.

Figure 13:
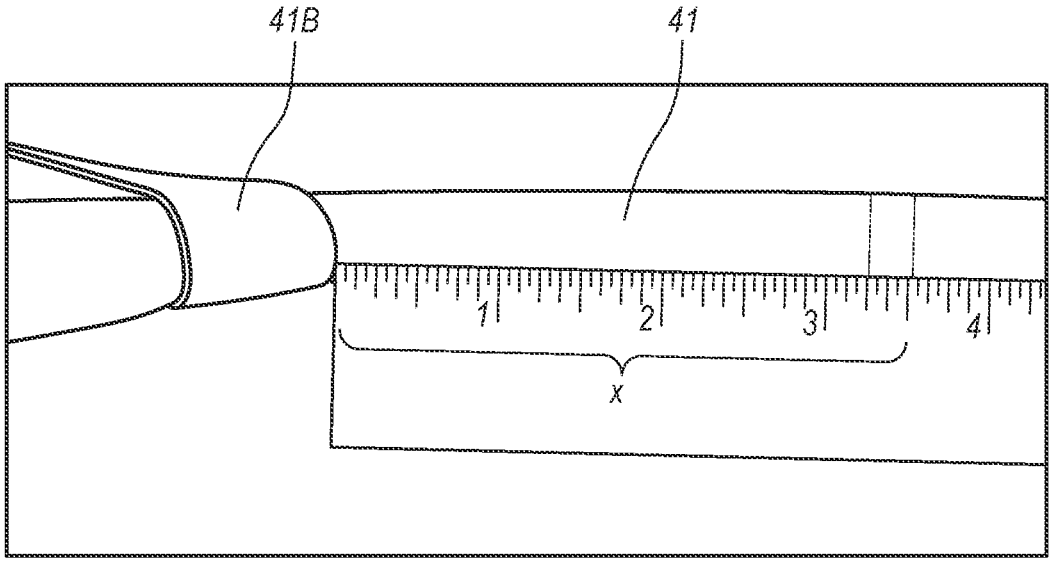
FIG. 13 shows the FIG. 12 view with a ruler showing a length of the lifeline which has been drawn out of the weave pattern after application of a pre-tensioning force has been applied to the lifeline to extract several inches of slack from the weave pattern.

FIG. 13 shows the FIG. 12 view with a ruler showing a length of the lifeline 41 which has been drawn out of the weave pattern after application of a pre-tensioning force has been applied to the lifeline 41 to extract several inches of slack from the weave pattern. Testing was conducted and with minimum slack in lifeline passing through the MOLLE/PAL webbing loops 14 and lifeline worker end loop 41B using the weave method of attachment. In this test and configuration, the lifeline 41 cinches up or tightens within the various loops 14, 41B in approximately 3½ inches (see FIGS. 12 and 13) of drawn out slack. This arrangement also prevents constriction of a worker's body when the slack is drawn out.

FIG. 14 shows an exemplary pulley and temporary exemplary attaching structure assembly 71 that can be used to alter a withdrawal or extraction path from a direct path to an indirect path to avoid obstacles or hazards that otherwise would be encountered via a direct withdrawal path. A temporary attaching system 71A is attached to a pulley section of the pulley and attaching structure assembly 71 to enable coupling of an exemplary temporary attaching structure 71A which is used in FIG. 17A-B. Use of an embodiment where a pulley is incorporated with an exemplary lifeline or line 41 enables the Safety Observer to extract the electrical worker directly away from the power source or hazard site when it would otherwise not be possible due to obstructions. A secondary benefit associated with this embodiment can include a case where if the electrical worker is incapacitated and the Safety Observer holds tension on a lifeline or line through the temporarily installed pulley, a potential for a secondary injury of falling to the deck is mitigated or removed as the pulley holds them up from the deck. The temporary nature of attachment of the pulley in this embodiment avoids a need to damage or significantly alter a given structure that they pulley is connected with.

Figure 15:
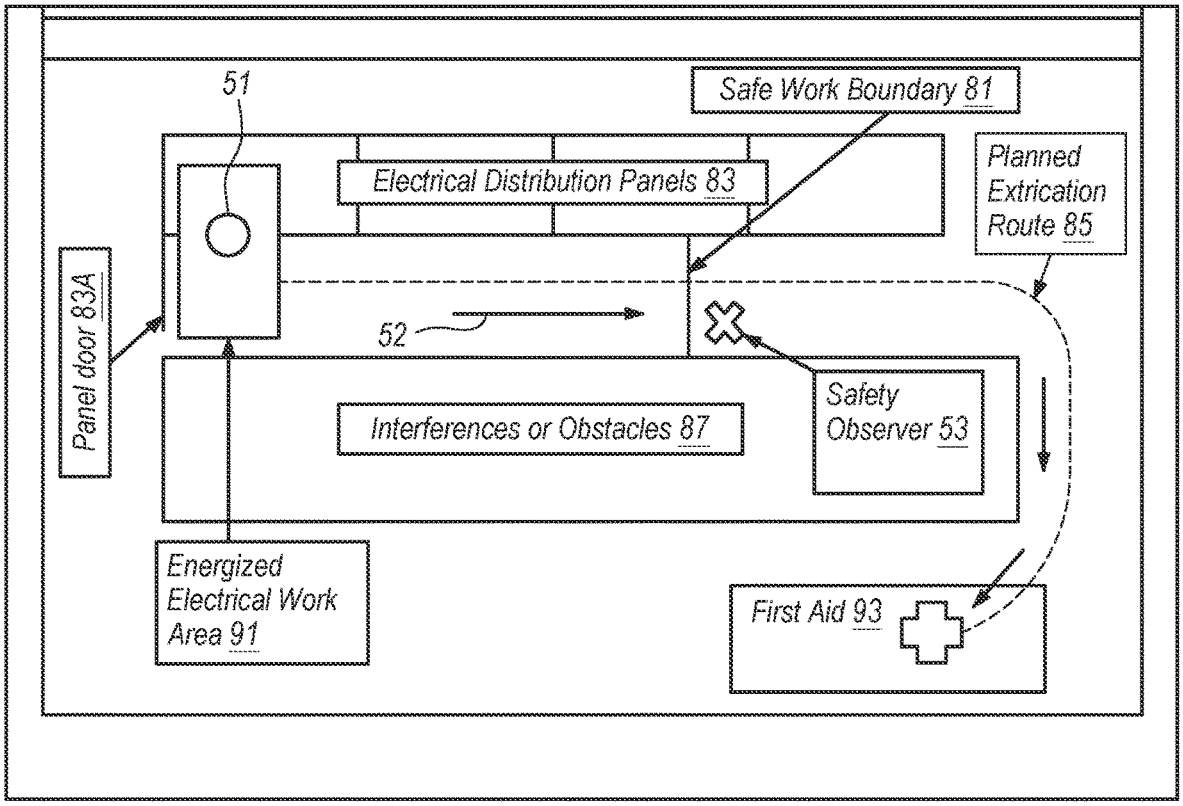
FIG. 15 shows a simplified overhead view of a direct withdrawal path to a first location where drag or grab handles can then be used to move an injured worker to a first aid station.

FIG. 15 shows a simplified overhead view of a direct withdrawal path 52 to a first location past a safe work boundary 81 where drag or grab handles 8A can then be used to move an injured worker to a first aid station 83 along a planned extrication route 85. A given path to remove a worker may be blocked such as, by panel door 83A and interferences or obstacles 87. This shows an example of a how such obstructions require determining a movement path or axis to orient a lifeline or line 41 with regard to a given worker 51 within a danger area or energized electrical work area 91.

Figure 16:
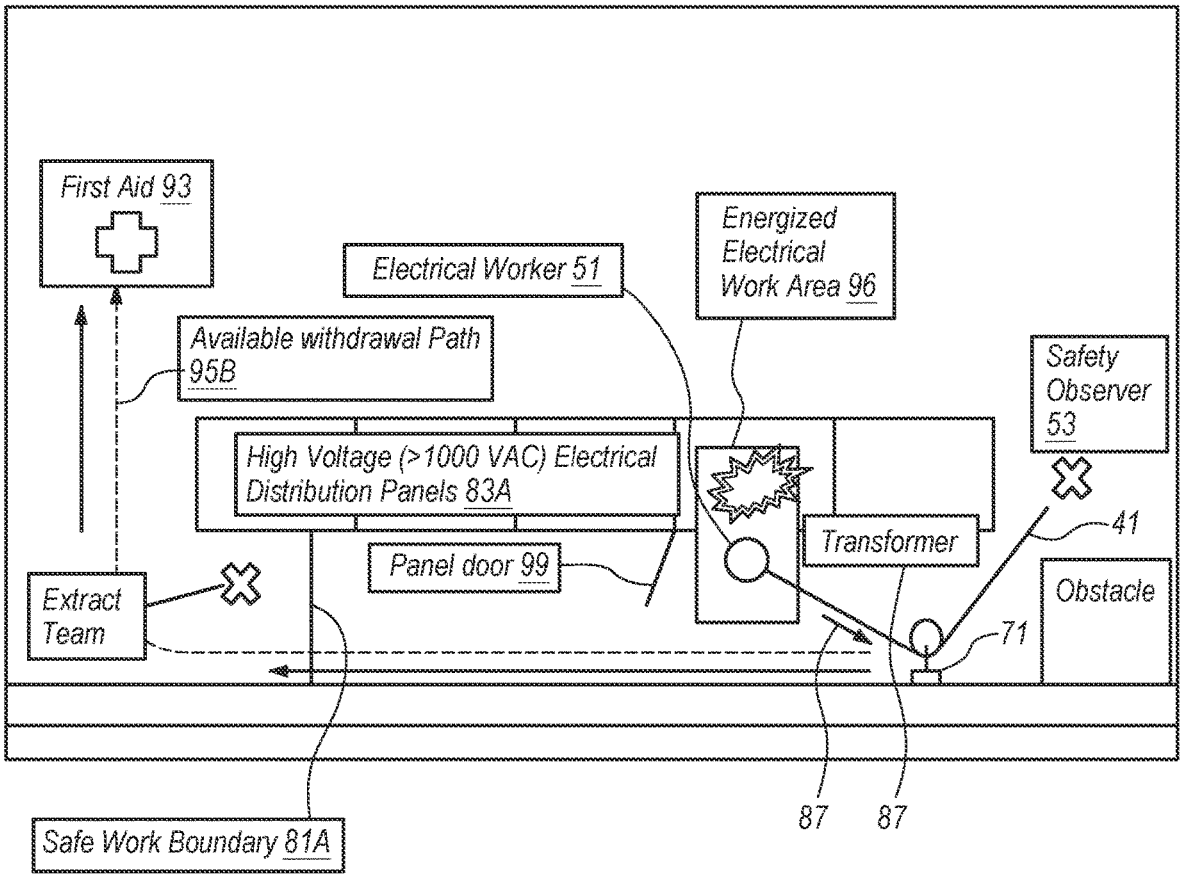
FIG. 16 shows another simplified overhead view of a withdrawal path but in this embodiment the FIG. 14 pulley and temporary exemplary attaching structure are used to enable an indirect withdrawal path to avoid a hazard.

FIG. 16 shows another simplified overhead view of a withdrawal path 95B but in this embodiment the FIG. 14 pulley 91 temporary exemplary attaching structure 91 are used to enable an indirect withdrawal path 87 to a start location of an available withdrawal path to pull a worker from an energized electrical work area 96 and also avoid an additional 87 (e.g., a transformer) hazard. Note, in this embodiment, the pulley 91 can be fitted with a secondary release mechanism to enable selective detachment from a mounting surface. An alternative embodiment or configuration can also have a second lifeline along the available withdrawal path 95B that can be used to haul a worker in distress past a safe work boundary 81A where grab or drag handles 8A can be used to further transport a worker to an aid station 93 while getting them past an additional obstacle such as a panel door 99. This arrangement may be called for when extremely high levels of voltage are present e.g., in excess of one thousand volts AC in an electrical distribution panel 83A. In this way, a safety observer 53 can safely move a worker away from multiple threats. The Lifeline should be attached to provide the best angle/location that moves the worker down the extrication route.

For the situation posed in FIG. 16, the electrical worker is working in a High Voltage Distribution Panel with the extrication path obscured by the panel door. This prevents the Safety Observer from standing at the work boundary. However, there is a gap between the panel and a transformer that will allow the Safety Observer to extract the electrical worker from the panel with the use of a pulley with a quick-mount system. The quick-mount system 71A embodiment can include high strength magnets, clamps and/or strapping. This will allow the quick mount system 71 to mount the pulley 71 at an optimum location to enable a safe withdrawal path and avoid a dangerous object such as transformer 87. The pulley 71 should be mounted above the electrical worker and at an optimum angle that will ensure the safe extraction of the worker from an energized work area, e.g., panel 83A. Prior to the electrical worker opening the panel door 99, the safety observer 53/electrical worker 51 can feed the lifeline 41 to the Safety Observer 53 through the pulley 71. The workers should ensure the lifeline 41 is clear of any sharp edges. The Safety Observer 53 will utilize wrist loops (not shown but see above) on the life line 41 for positive control of the electrical worker 51 (selection of a particular wrist loop enables adjustment of length of the lifeline 41 between Safety Observer 53 and worker 41 to removing or adding slack and thereby reducing response time from when the Safety Observer pulls on the lifeline 41 and when the worker 51 actually moves away from a hazard). The Safety Observer 53 can stand with their arm and lifeline 41 extended to their front facing a direction that they wish the lifeline 41 to travel towards them when they pull on the lifeline 41. A given facing and orientation of the Safety Observer 53 will ensure that the Safety Observer 53 is able to have sufficient ability to apply a pulling force with sufficient motion of travel in movement of their arm(s) to extract the worker 51 quickly. In the event of an electrocution or arc flash/blast, the Safety Observer 53 will apply force to the lifeline 41 to extract the electrical worker 51 from the energized electrical work area 96. If the Safety Observer 53 extracts the electrical worker to the immediate vicinity of the pulley 71 and holds a strain on the lifeline 41, the risk of a secondary physical injury to the worker is minimized (e.g., prevents the worker from falling down). When the worker has been isolated from the energized electrical work area 96 source/additional hazard 87 and/or the hazard source(s) have been de-energized, an extraction team can then shut the panel door 83A and grasp the worker 51 by the drag handles 8A. The electrical worker can then be removed to a point of safety where medical personnel can administer first aid.

Figure 17A:
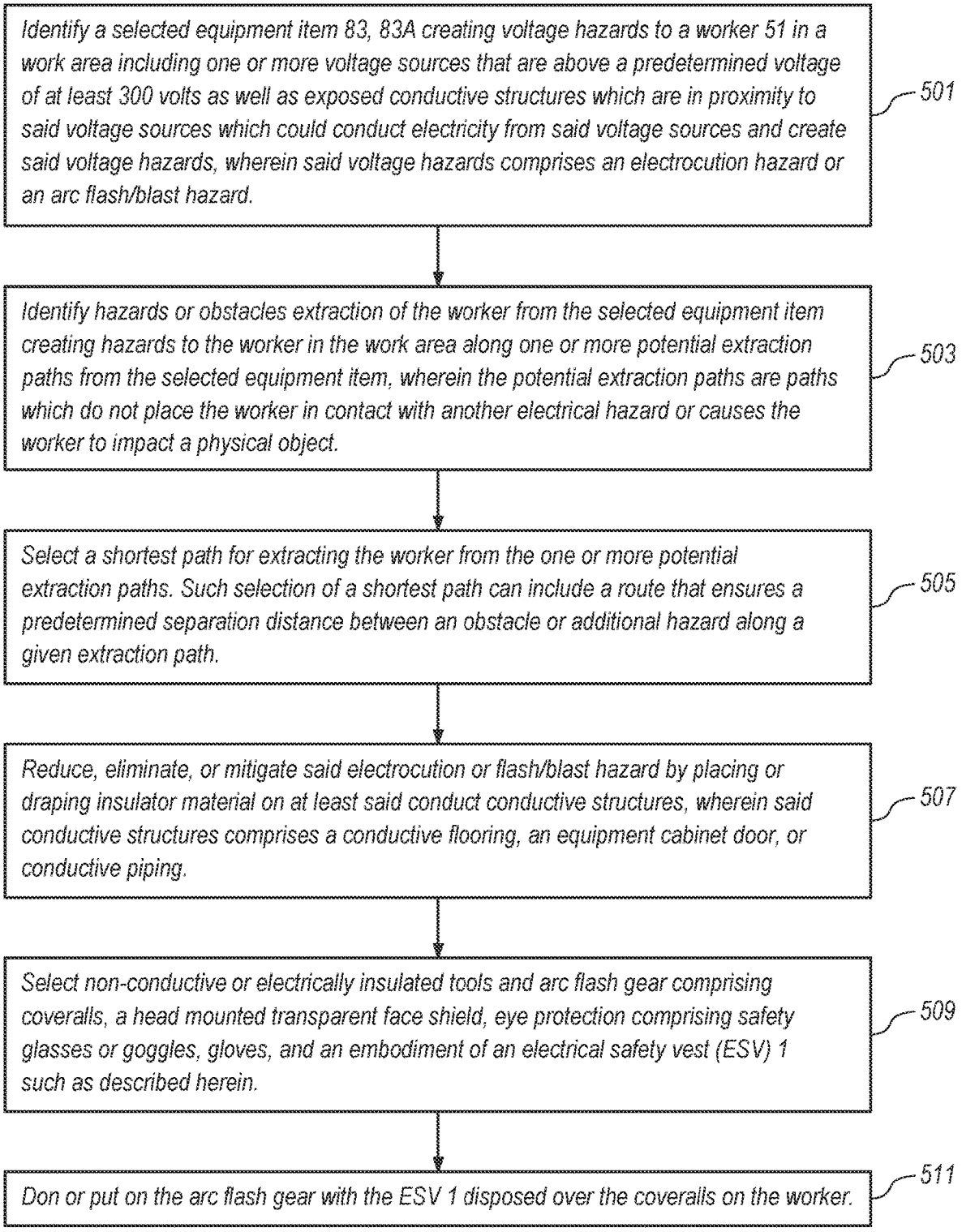
FIGS. 17A-17B shows another exemplary method for using an exemplary electrical safety system including an exemplary electrical safety vest in accordance with one embodiment of the invention.
Figure 17B:
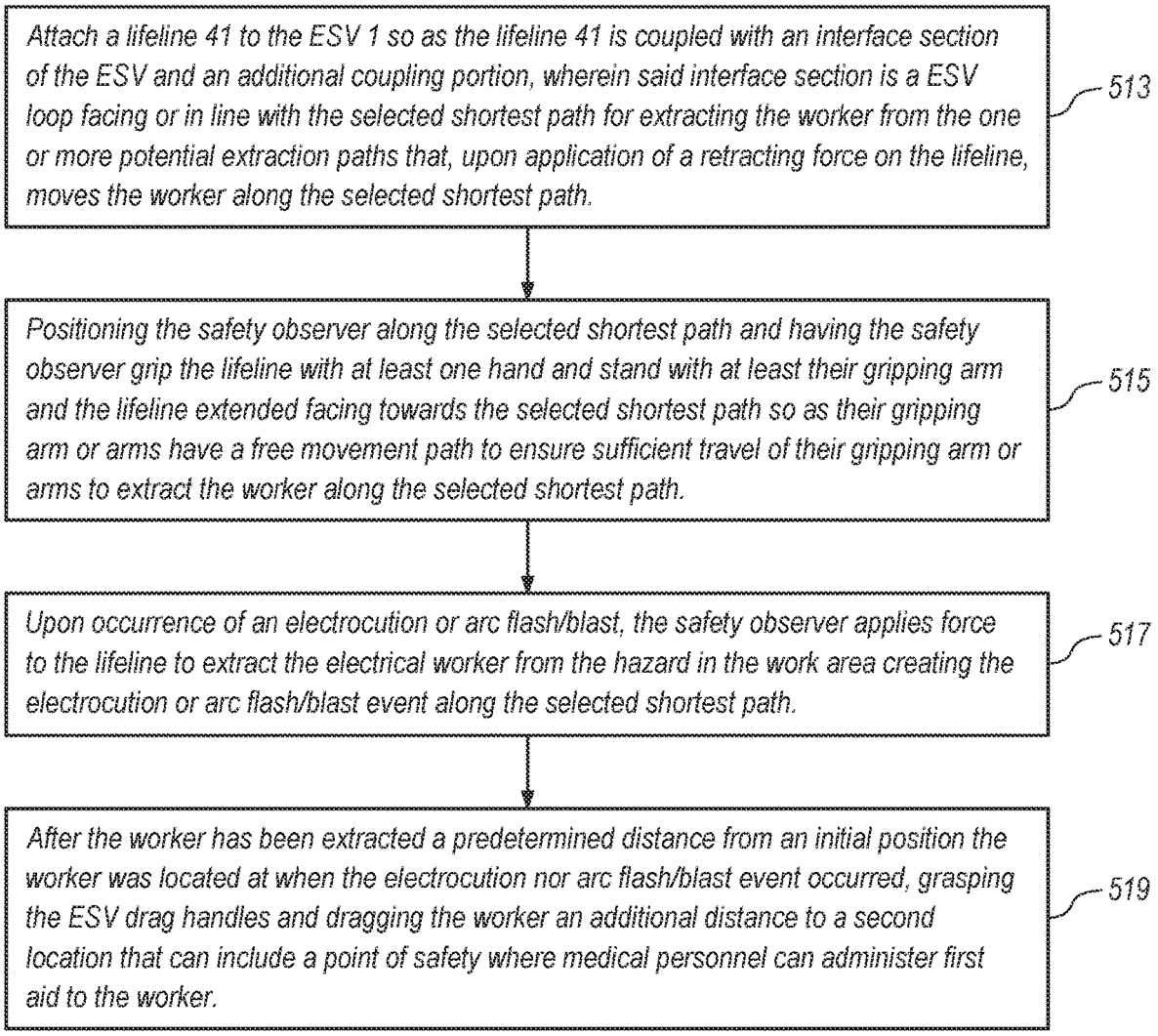

FIG. 17A-17B shows another exemplary method for using an exemplary electrical safety system including an exemplary flexible vest or enclosing structure 1 (hereinafter electrical safety vest (ESV)) in accordance with one embodiment of the invention. In particular, at Step 501: Identify a selected equipment item 83, 83A creating voltage hazards to a worker 51 in a work area including one or more voltage sources that are above a predetermined voltage of at least 300 volts as well as exposed conductive structures which are in proximity to said voltage sources which could conduct electricity from said voltage sources and create said voltage hazards, wherein said voltage hazards comprises an electrocution hazard or an arc flash/blast hazard. At Step 503: Identify hazards or obstacles extraction of the worker from the selected equipment item creating hazards to the worker in the work area along one or more potential extraction paths from the selected equipment item, wherein the potential extraction paths are paths which do not place the worker in contact with another electrical hazard or causes the worker to impact a physical object. At Step 505: Selecting a shortest path for extracting the worker from the one or more potential extraction paths. Such selection of a shortest path can include a route that ensures a predetermined separation distance between an obstacle or additional hazard along a given extraction path. At Step 507: Reduce, eliminate, or mitigate said electrocution or flash/blast hazard by placing or draping insulator material on at least said conduct conductive structures, wherein said conductive structures comprises a conductive flooring, an equipment cabinet door, or conductive piping. At Step 509: Select non-conductive or electrically insulated tools and arc flash gear comprising coveralls, a head mounted transparent face shield, eye protection comprising safety glasses or goggles, gloves, and an embodiment of the ESV 1 such as described herein. At Step 511: Don or put on the arc flash gear with the ESV 1 disposed over the coveralls on the worker. At Step 513: Attach a lifeline 41 to the ESV 1 so as the lifeline 41 is coupled with an interface section of the ESV and an additional coupling portion, wherein the coupling portion is an ESV section where the lifeline is passed through multiple loops on a selected coupling portion of the ESV in a weaving pattern of passing the lifeline through one loop then over an adjacent loop in a weaving direction then through a next adjacent loop along the weaving direction along a lifeline attaching path which includes a plurality of path segments which maximize engagement with the ESV loops in said additional coupling portion of the ESV (e.g., see FIG. 7, 12), wherein said interface section is a ESV loop facing or in line with the selected shortest path for extracting the worker from the one or more potential extraction paths that, upon application of a retracting force on the lifeline, moves the worker along the selected shortest path. Note, in an alternative embodiment one or more of the potential extraction paths and therefore the selected shortest path of the potential extraction paths can be enabled by use of passing a portion of the lifeline through a pulley or equivalent coupled to a mounting point via a removable mounting structure to enable an indirect or altered worker extraction path so as to avoid an identified location which can include a physical or electrical hazard. A safety observer will one of a plurality of spaced apart wrist loops on a section of the lifeline on an opposing end of the lifeline and pass one of their wrists through the selected wrist loop so as to ensure the safety observer is coupled with the lifeline via at least the selected wrist loop. At Step 515: Positioning the safety observer along the selected shortest path and having the safety observer grip the lifeline with at least one hand and stand with at least their gripping arm and the lifeline extended facing towards the selected shortest path so as their gripping arm or arms have a free movement path to ensure sufficient travel of their gripping arm or arms to extract the worker along the selected shortest path. At Step 517: Upon occurrence of an electrocution or arc flash/blast, the safety observer applies force to the lifeline to extract the electrical worker from the hazard in the work area creating the electrocution or arc flash/blast event along the selected shortest path. At Step 519: After the worker has been extracted a predetermined distance from an initial position the worker was located at when the electrocution nor arc flash/blast event occurred, grasping the flexible vest or enclosing structure 1 (e.g., electrical safety vest or ESV) drag handles and dragging the worker an additional distance to a second location that can include a point of safety where medical personnel can administer first aid to the worker.

Several improvements or alternative embodiments can further include various adjustments or variations to the leg straps that can be provided such as, e.g., providing stitching for the PALS webbing to the buckles that is moved away from the buckles to allow more overlap on the front for smaller sized torsos. Another potential improvement can include replacing impact foam and webbing with fire retardant cushioning material. This modification should ensure it passes the 40 cal/cm2 test. Another potential improvement can include removal/reducing the collar to prevent interference with an arc flash hard hat.

Although the invention has been described in detail with reference to certain preferred embodiments, variations and modifications exist within the spirit and scope of the invention as described and defined in the following claims.

The invention claimed is:

1. An electrical safety system comprising:

a flexible vest formed with a first, second and third enclosing panels or sections, wherein the flexible vest is formed with a first and second arm aperture sections respectively formed between the first and second as well as the first and third enclosing panels or sections;

a plurality of first and second adjustable straps and buckles respectively attached to and for coupling opposing and adjacent facing edge sections of the second and third enclosing panels or sections;

a plurality of flexible handle grip sections attached respectively to the first, second and third enclosing panels or sections in proximity to the first and second arm aperture sections and a collar section of the flexible vest;

a plurality of spaced apart MOLLE/PALS loops disposed on or coupled with the first, second and third enclosing panels or sections and with the first and second adjustable straps and buckles;

a plurality of first protection extension panels detachably coupled with a side of the flexible vest opposing the collar section of the vest, each of the first protection extension panels formed with a sheet section and one or more coupling sections that selectively couples the first protection extension panels with the flexible vest;

a plurality of foam or cushion sections coupled with one or more sections of the first, second, and third enclosing panels or sections as well as the plurality of first protection extension panels; and a lifeline interface section comprising an interface area of the MOLLE/PALS loops and a line passing through the MOLLE/PALS loops using a weave pattern of attachment that cinches up or tightens the line within the MOLLE/PALS loops in an arrangement configured to prevent constriction of a worker's body when the slack is drawn out of the line.

2. The system as in claim 1, further comprising a selectively attachable pulley system that slidably receives the line.

3. The system as in claim 2, wherein the selectively attachable pulley system comprises a magnet or a clamping system for removably attaching the pulley system to another structure.

4. A system as in claim 1, wherein the line comprises a Kevlar material that is at least eight feet in length.

* * * * *